US006217358B1

(12) United States Patent
Norizuki et al.

(10) Patent No.: US 6,217,358 B1
(45) **Date of Patent: *Apr. 17, 2001**

(54) CONNECTOR COUPLING STRUCTURE

(75) Inventors: Teruhisa Norizuki; Shinji Kodama, both of Shizuoka-ken (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/131,236

(22) Filed: Aug. 7, 1998

(30) Foreign Application Priority Data

| | | |
|---|---|---|
| Aug. 8, 1997 | (JP) | 9-215087 |
| Aug. 8, 1997 | (JP) | 9-215139 |
| Aug. 8, 1997 | (JP) | 9-215249 |
| Aug. 8, 1997 | (JP) | 9-215250 |
| Aug. 8, 1997 | (JP) | 9-215304 |

(51) Int. Cl.[7] ..... H01R 13/64
(52) U.S. Cl. ..... 439/247; 439/248
(58) Field of Search ..... 439/247, 248, 439/246, 249, 374, 376

(56) References Cited

U.S. PATENT DOCUMENTS

| | | | | |
|---|---|---|---|---|
| 4,998,889 | * | 3/1991 | Moly | 439/247 |
| 5,591,040 | | 1/1997 | Dohan et al. | 439/248 |
| 5,651,683 | | 7/1997 | Shimamura et al. | 439/34 |
| 5,755,584 | * | 5/1998 | Kodama et al. | 439/248 |
| 5,788,522 | * | 8/1998 | Kameyama | 439/248 |
| 5,919,053 | * | 7/1999 | Tsui et al. | 439/157 |
| 5,921,796 | * | 7/1999 | Morlion et al. | 439/247 |
| 5,934,935 | * | 8/1999 | Kameyama | 439/535 |

FOREIGN PATENT DOCUMENTS

| | | |
|---|---|---|
| 0 477 692 A1 | 4/1992 | (EP) . |
| 9-55262 | 2/1997 | (JP) . |

* cited by examiner

*Primary Examiner*—Gary F. Paumen
*Assistant Examiner*—Alexander Gilman
(74) *Attorney, Agent, or Firm*—Finnegan, Henderson, Farabow, Garrett & Dunner, L.L.P.

(57) ABSTRACT

One of female and male connectors is installed on a mounting base in a waiting through a holder in a waiting condition, and can be freely coupled with the other connector in a projecting waiting direction of the one connector. The one connector is provided freely slidably in the holder and after the other connector is coupled with the one connector, both the connectors are freely slidable relative to the holder toward the mounting base while in a coupling condition. A clearance is provided between the holder and the one connector. A hood of the one connector is provided slidably in the holder. A flexible arm of the holder has an engaging portion at an end thereof. The one connector includes a flexible engaging piece having an engaging portion to be fit to/released from the engaging portion of the flexible arm; and the flexible engaging piece is freely contactable with a side wall in the vicinity of the flexible arm of the holder.

12 Claims, 17 Drawing Sheets

CONNECTOR COUPLING STRUCTURE

BACKGROUND OF THE INVENTION

1. Field of the Invention

This invention relates to a connector coupling structure which is used in, for example, vehicle door and is preferable for coupling female and male connectors having multiple poles with each other or uncoupling them.

2. Description of the Relevant Art

In a vehicle door, a switch unit such as a power window switch unit is installed on a door trim by fitting a connector of wire harness placed on the door panel to a connector of switch unit to be installed on the door panel through a door trim.

FIG. 1 is a diagram for explaining an installation procedure of a conventional connector for vehicle door.

First, a wire harness 102 is placed on a door panel 101 and next waterproof sheet 103 is bonded to this door panel 101. A switch unit such as a power window switch unit is installed on a door trim 105 and a connector 107 of the switch unit 104 is fit to a connector 106 which is connected to an end of the wire harness 102 placed in the door panel 101 and finally the door trim 105 is installed on the door panel 101.

A connector coupling structure suitable for this kind of use has been disclosed in Japanese Patent Application Laid-Open Publication No. 9-55262.

FIGS. 2A to 2D are diagrams for explaining a conventional connector coupling structure.

In the conventional connector coupling structure, as shown in FIG. 2A, a female connector 205 provided on an electrical device 204 is fit to a male connector 201 which is inserted into an insertion hole 208*a* of a connector mounting plate 208 through a mounting opening 209*a* of an instrumental panel 209. This male connector 201 has a flexible engaging piece 202. Prior to fitting of the male connector 201, a protrusion 202*a* provided on the engaging piece 202 is engaged with a fitting hole 208*a* of the connector mounting plate 208. As shown in FIGS. 2B, 2C, the female connector 205 is inserted through the mounting opening 209*a* of the instrumental panel 209 and fit to the male connector 201. As a result, when the female connector 205 is normally fit to the male connector 201, the engaging piece 202 deflects downward so that a hook portion 203 on a front end of the engaging piece 202 is embedded into a recess hole 206 of the female connector 205. When the electrical device 204 is further pressed from this condition, as shown in FIG. 2D, the male connector 201 is forced up to an assembly position, so that the female connector 205 is locked within the mounting opening 209*a* of the instrumental panel 209 through a locking piece 204*a* of the electrical device 204.

According to the installation procedure of the conventional vehicle connectors, after the switch unit 104 is installed on the door trim 105, the connector 107 of the switch unit 104 is fit to the connector 106 connected to the end of the wire harness 102 placed in the door panel 101. Thus, the coupling of both the connectors 106, 107 is carried out by manual sensing method (the manual sensing work portion is indicated by symbol B in FIG. 1) so that work efficiency is poor. Further, because the connector 106 is located at an end of the long wire harness 102, when the door trim 105 is installed on the door panel 101 after the connector 107 of the switch unit 104 is fit to the connector connected to the end of the wire harness 102 placed in the door panel 101, catching of the wire harness 102 or the like occurs thereby leading to a connection failure of the wire harness 102, disconnection or the like.

In the above described conventional connector coupling structure, because there is formed a tapered face 202*b* on a rear portion of the protrusion 202*a* of the engaging piece 202 of the male connector 201, the male connector 201 is likely to retract on halfway of coupling of both the connectors 201, 205, so that it is difficult to install both the connectors 201, 205 at a normal position with both the connectors being coupled with each other completely. For example, if both the connectors 201, 205 are uncoupled for maintenance and inspection, the male connector 201 remains drooping behind the connector mounting plate 208, so that it is impossible to couple both the connectors 201, 205 with each other again when the maintenance and inspection is completed. If the wire harness connected to the male connector 201 is pulled for some reason after both the connectors 201, 205 are fit to each other, there is a fear that the connectors 201, 205 may be uncoupled because there is no locking means provided between both the connectors 201 and 205. Further, because both the connectors 201, 205 are fit to each other by only a holding force between a female terminal (not shown) of the male connector 201 and a male terminal 207 of the female connector 205, the fitting force between both the connectors 201 and 205 is insufficient so that it is weak against a vibration, thereby often producing looseness, abnormal noise and the like.

SUMMARY OF THE INVENTION

The present invention has been achieved with such points in view.

It therefore is an object of the present invention to provide a connector coupling structure enabling the female and male connectors to be coupled with each other and preventing a wire connection failure.

Another object of the present invention is to provide a connector coupling structure enabling the female and male connectors to slide easily relative to a holder in a coupling completion condition, capable of preventing an occurrence of abnormal noise and excellent in anti-vibration performance.

Still another object of the present invention is to provide a connector coupling structure enabling the coupling of the female and male connectors to be carried out easily and accurately.

A further object of the present invention is to provide a connector coupling structure capable of preventing slippage of both the connectors from the coupling state.

A first aspect of the present invention provides a connector coupling structure in which one of female and male connectors is installed on a mounting base in such a waiting condition that it projects through a holder and the one connector is capable of being freely coupled with the other connector in a direction of the projected waiting condition of the one connector, the connector coupling structure being so that the one connector is provided freely slidably in the holder and after the other connector is coupled with the one connector, both the connectors are freely slidable relative to the holder in a coupling completion condition toward the mounting base.

According to the connector coupling structure, both the female and male connectors can be easily coupled with each other and the coupling thereof can be easily confirmed thereby improving work efficiency. Further because the pulling out of the wire is not needed, catching of the wire or the like is prevented so that a connection failure of the wire, disconnection and the like are prevented.

A second aspect of the present invention provides a connector coupling structure according to the first aspect wherein the holder is cylindrical in shape and both the coupled connectors are slidably provided in the cylindrical holder.

According to the connector coupling structure, both the coupled connectors slide linearly toward the mounting base thereby shortening an installation time to the mounting base.

A third aspect of the present invention provides a connector coupling structure according to the first aspect wherein the switch installed on a other connector is installed in a switch mounting hole provided in another mounting base and the switch installed in the switch mounting hole is lockable with a locking means.

According to the connector coupling structure, an installation error between the mounting base and other mounting base and looseness are absorbed so that both the connectors are never loose or vibrated thereby preventing an occurrence of abnormal noise due to vibration or the like.

A fourth aspect of the present invention provides a connector coupling structure in which one of female and male connectors is installed on a mounting base in such a waiting condition that it projects through a holder and the one connector is capable of being freely coupled with the other connector in a direction of the projected waiting condition of the one connector, the connector coupling structure being so constructed that a clearance is provided between the holder and the one connector such that the one connector is provided slidably in the holder and when the coupling of the one connector and the other connector is completed, both the connectors are freely slidable relative to the holder in the coupling completion condition toward the mounting base.

According to the connector coupling structure, because the female and male connectors are aligned with each other, they are coupled with each other smoothly. Both the connectors slide easily relative to the holder in the completely coupled condition and installed to the mounting base. As a result, vibration and the like are prevented improving anti-vibration performance thereby preventing an occurrence of abnormal noise.

A fifth aspect of the present invention provides a connector coupling structure according to the fourth aspect wherein a switch installed on the other connector is installed in a switch mounting hole provided in another mounting base and the clearance between the holder and the one connector is set so as to be larger than the clearance between the switch mounting hole and the switch.

According to the connector coupling structure, an installation error between the mounting base and other mounting base and looseness are absorbed where the sliding of both the connectors in the coupling completion condition ends, so that both the connectors are never loose or vibrated thereby preventing an occurrence of abnormal noise.

A sixth aspect of the present invention provides a connector coupling structure in which one of female and male connectors is installed on a mounting base in such a waiting condition that it projects through a holder and the one connector is capable of being freely coupled with the other connector in a direction of the projected waiting condition of the one connector, the connector coupling structure being so constructed that a hood of the one connector is provided slidably in the holder; the holder and hood of the one connector are each provided with an engaging means for holding the one connector in the projected waiting condition, the other connector is provided with a holding means for holding the engagement of each of the engaging means when both of the connectors are coupled with each other and provided with a holding release means for releasing the engagement of each of the engaging means when the coupling of both the connectors is complete; and when the coupling of both the connectors is complete, both the connectors are slidable relative to the holder in the completely coupled condition toward the mounting base.

According to the connector coupling structure, because the hood of one connector is provided slidably in the holder, the sliding performance of the one connector relative to the holder is improved.

A seventh aspect of the present invention provides a connector coupling structure according to the sixth aspect wherein the hood cylindrical in shape so that the cylindrical hood acts as a guide for the holder and the other connector.

According to the connector coupling structure, the other connector slides smoothly relative to one connector, so that both the connectors are coupled with each other securely. Further, the coupled connectors slide relative to the holder smoothly. As a result, vibration and the like are prevented improving anti-vibration performance thereby preventing an occurrence of abnormal noise.

An eighth aspect of the present invention provides a connector coupling structure according to the sixth aspect wherein the one connector comprises a housing having a plurality of terminal accommodating chambers and a hood for covering the housing.

According to the connector coupling structure, a plurality of connector housings using a pressure welding terminal, crimping terminal or the like can be used at the same time, thereby increasing general purpose usability.

A ninth aspect of the present invention provides a connector coupling structure in which one of female and male connectors is installed on a mounting base in such a waiting condition that it projects through a holder and the one connector is capable of being freely coupled with the other connector in a direction of the projected waiting condition of the one connector, the connector coupling structure being so constructed that the one connector is provided slidably in the holder; the holder and one connector are each provided with an engaging means for holding the one connector in the projected waiting condition; the other connector is provided with a holding means for holding the engagement of each of the engaging means when both the connectors are coupled with each other and a holding releasing means for releasing the engagement of each of the engaging means when both the coupling of both the connectors is completed and released; and both the connectors are freely slidable relative to the holder when the coupling of both the connectors is completed and released.

According to the connector coupling structure, the coupling and uncoupling of both the connectors are carried out easily and accurately. Further, because the engaging means of the holder and the engaging means of one connector are disposed at the same position and the other connector contains the holding means and holding releasing means, the entire size of the connector can be reduced.

A tenth aspect of the present invention provides a connector coupling structure according to the ninth aspect wherein a uncoupling face of the holding releasing means is a tapered face.

According to the connector coupling structure, the engagement between the engaging means of the holder and one connector can be released easily. Therefore, the other connector is easily released from one connector so that the uncoupling of both the connectors for maintenance and inspection and re-coupling thereof can be carried out easily and accurately.

An eleventh aspect of the present invention provides a connector coupling structure in which one of female and male connectors is installed on a mounting base in such a waiting condition that it projects through a holder; the one connector is capable of being freely coupled with the other connector in a direction of the projected waiting condition of the one connector; the one connector is provided slidably in the holder; the holder and one connector are provided each with an engaging means for holding the one connector in the projected waiting condition; the other connector is provided with a holding means for holding the engagement of each of the engaging means when both the connectors are coupled with each other and a holding releasing means for releasing the engagement of each of the engaging means when both the coupling of both the connectors is complete; and both the connectors are freely slidable relative to the holder toward the mounting base in the completely coupled condition when the coupling of both the connectors is complete, the connector coupling structure being so constructed that the engaging means of the holder is constituted with a flexible arm having an engaging portion at an end thereof; the engaging means of the one connector is constituted with a flexible engaging piece having an engaging portion to be fit to/released from the engaging portion of the flexible arm; and the flexible engaging piece is freely contactable with a side wall in the vicinity of the flexible arm of the holder.

According to the connector coupling structure, unnecessary warpage of the flexible engaging piece of one connector toward the side wall of the holder is prevented, so that uncoupling of both the connectors when both the connectors are coupled with each other and the coupling thereof is completed is prevented.

A twelfth aspect of the present invention provides a connector coupling structure according to the eleventh aspect wherein the width of the flexible engaging piece is set so as to be larger than the width of the engaging portion of the flexible arm.

According to the connector coupling structure, even if an unexpected load is applied to one connector or the like, the uncoupling of both the connectors can be prevented.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
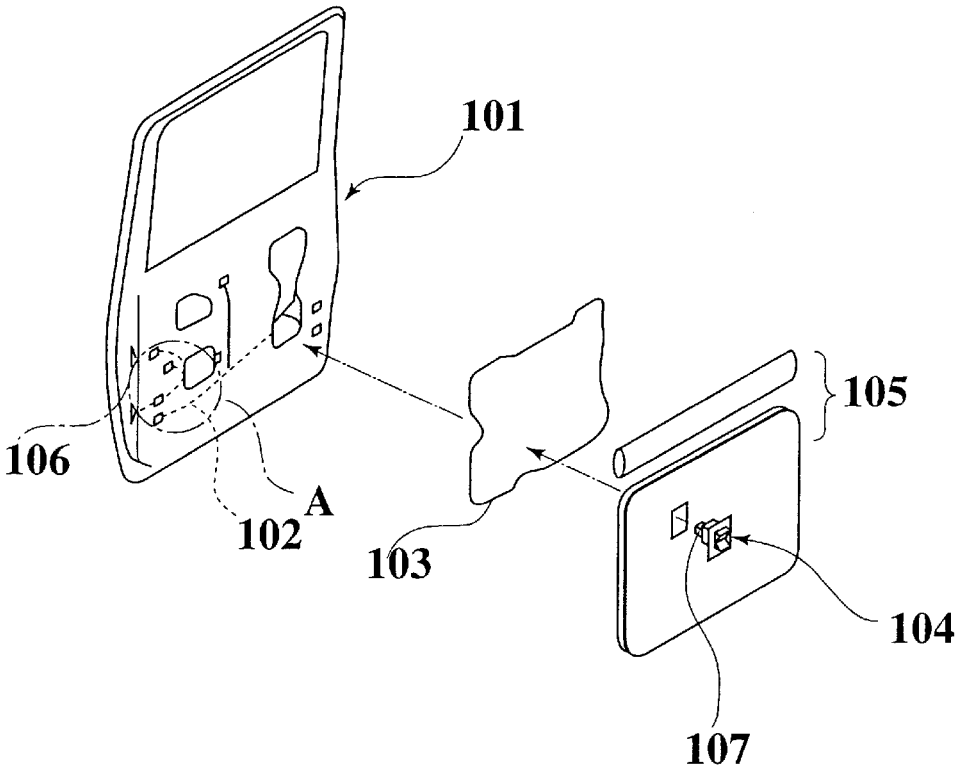
FIG.1 PRIOR ART
FIG. 1 is a disassembed perspective view of a conventional vehicle door.
Figure 2A:
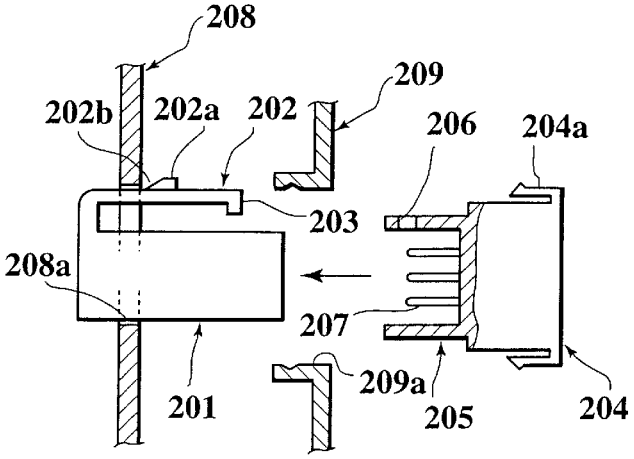
FIG.2A PRIOR ART
FIG. 2A is a sectional view of the conventional female and male connectors at the time of the coupling thereof.
Figure 2B:
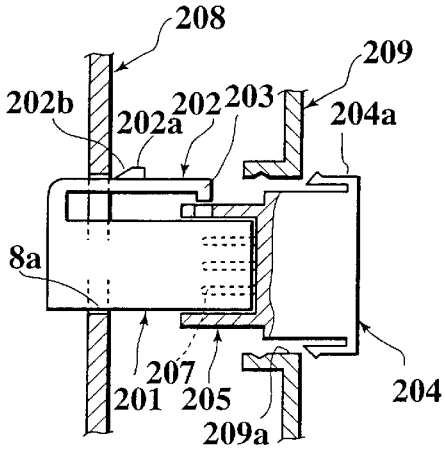
FIG.2B PRIOR ART
FIG. 2B is a sectional view of the conventional female and male connectors on halfway of the coupling thereof at a normal position.
Figure 2C:
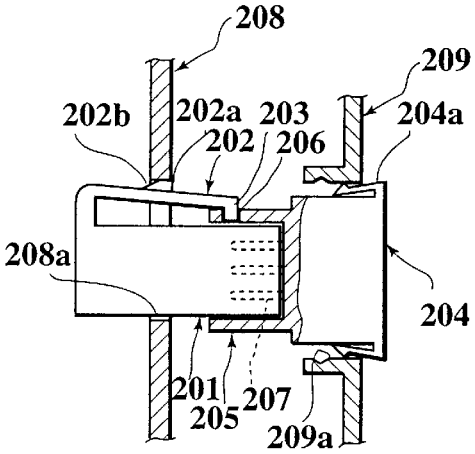
FIG.2C PRIOR ART
FIG. 2C is a sectional view of the conventional female and male connectors when the coupling thereof is completed.
Figure 2D:
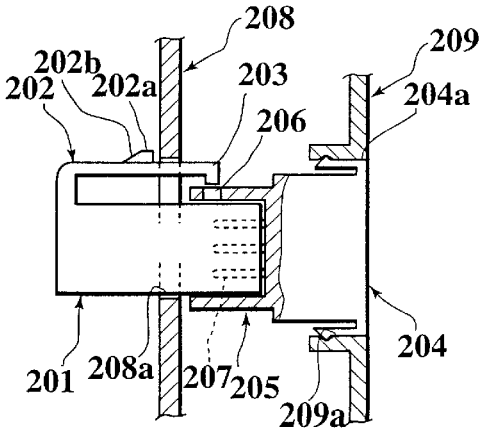
FIG.2D PRIOR ART
FIG. 2 is a sectional view of conventional female and male connectors prior to coupling thereof.

There will be detailed below the preferred embodiments of the present invention with reference to the accompanying drawings. Like members are designated by like reference character.

Figure 3:
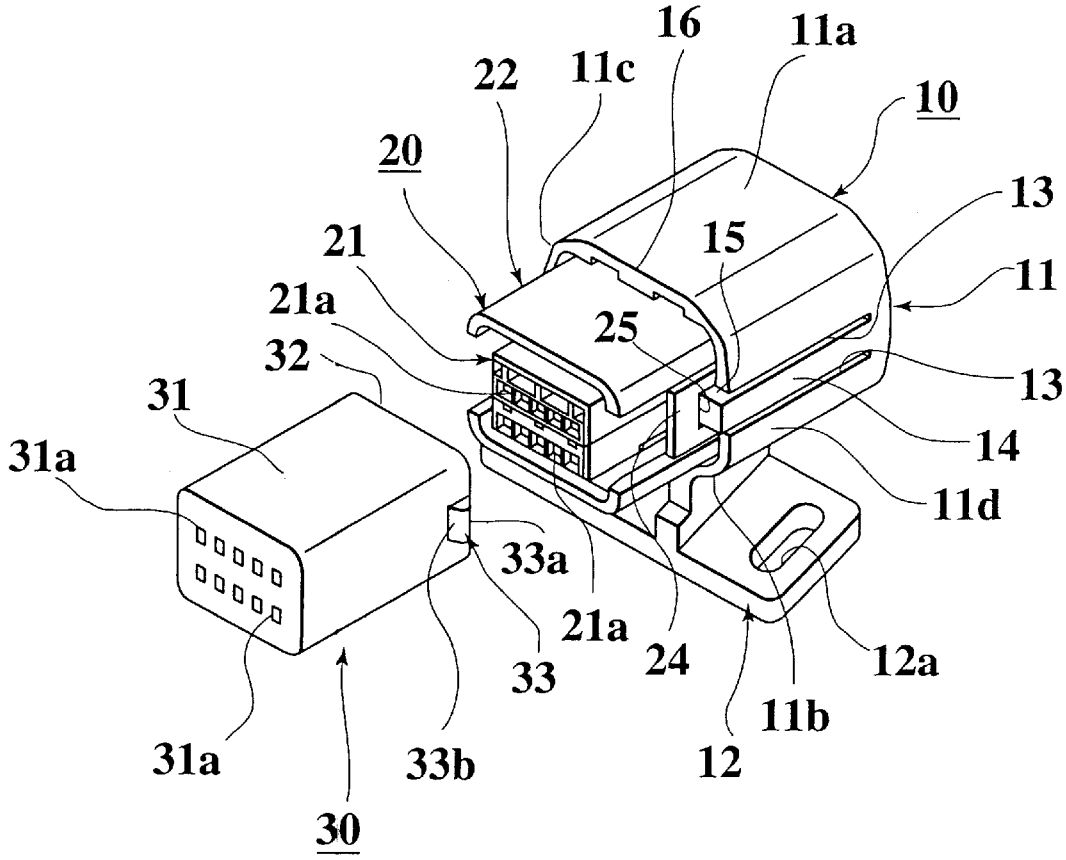
FIG. 3 is a perspective view showing a state prior to the coupling of the female and male connectors in a connector coupling structure according to an embodiment of the present invention.
Figure 5:
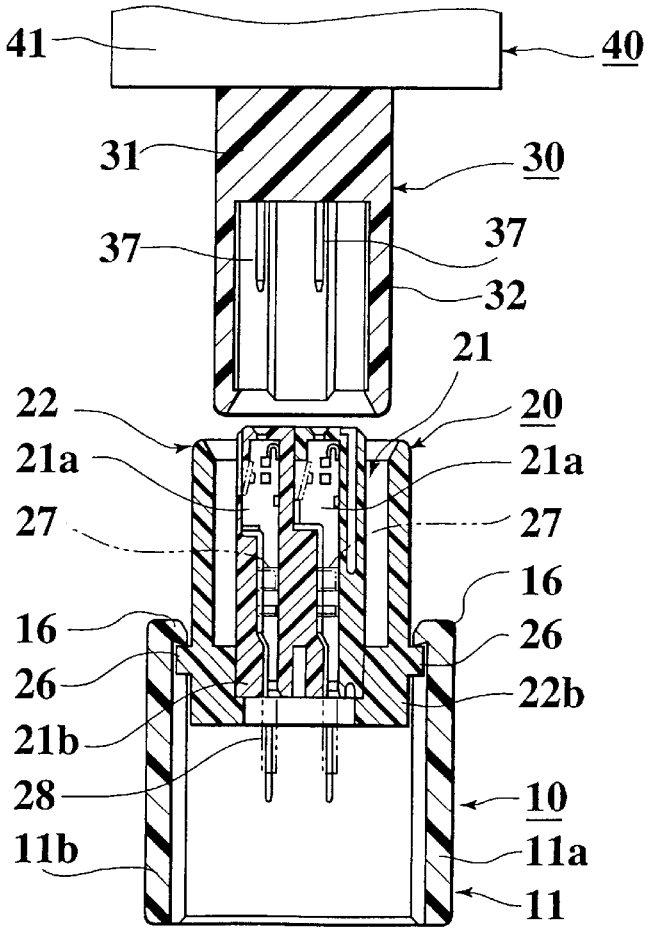
FIG. 5 is a sectional view showing a state prior to the coupling of the connectors of FIG. 3.
Figure 9:
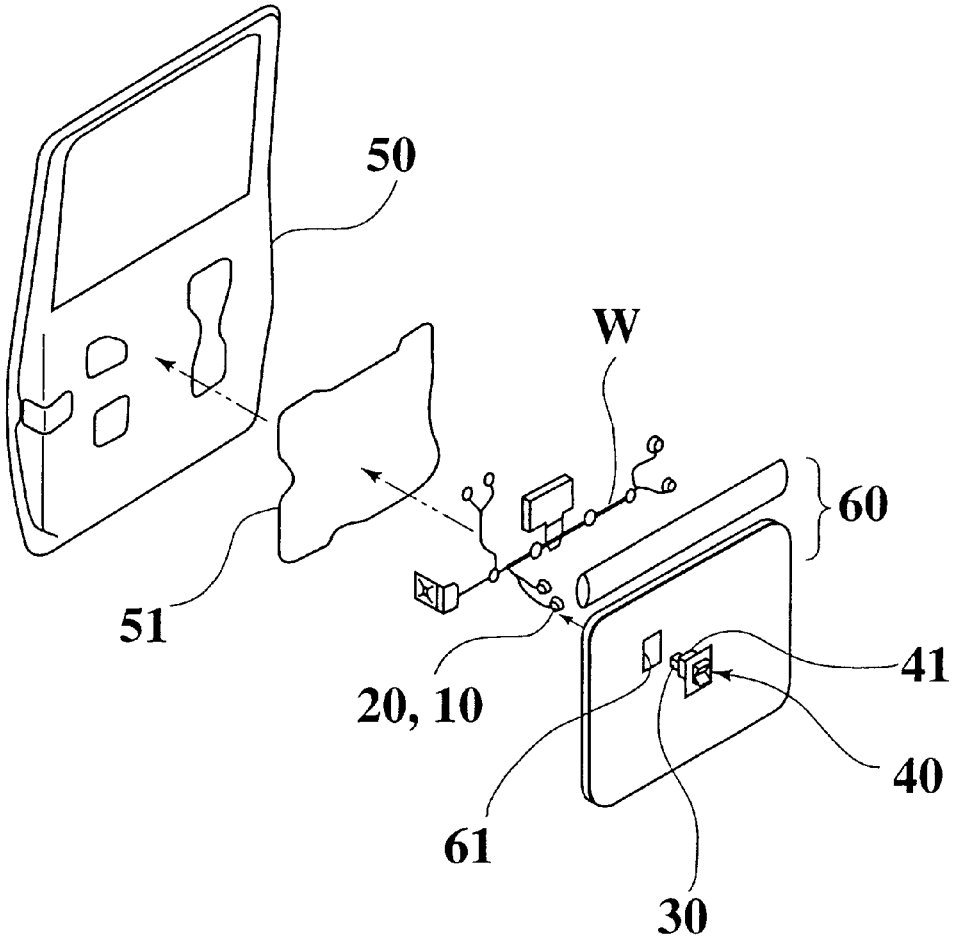
FIG. 9 is a disassembly perspective view of the vehicle door to which the connector coupling structure of FIG. 3 is applied.
Figure 10:
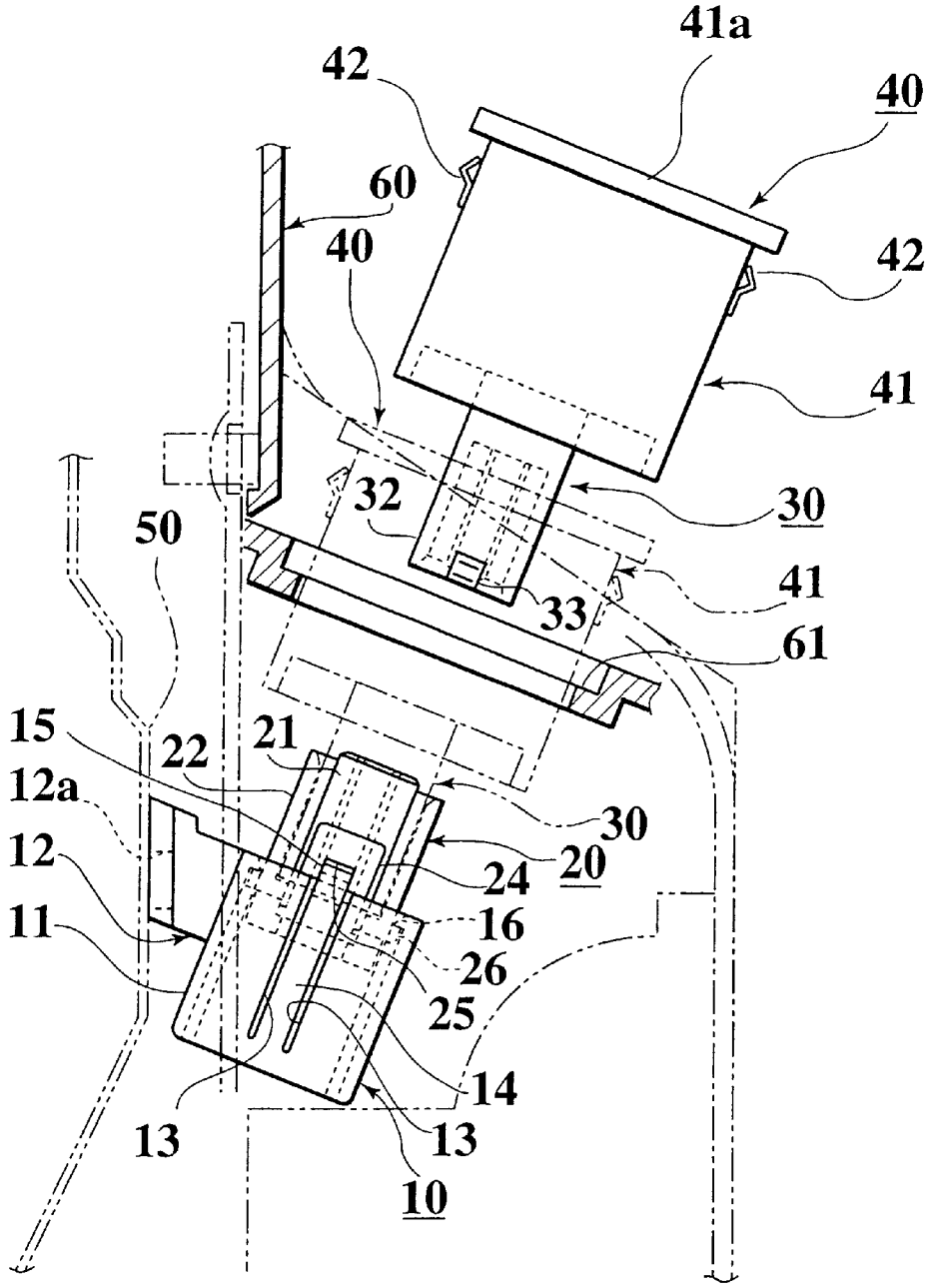
FIG. 10 is an explanatory view showing a state prior to the installation of the female and male connectors having the connector coupling structure applied to the vehicle door switch.

FIG. 3 is a perspective view showing a state prior to coupling of a female connector and a male connector to be used in a connector coupling structure of the present invention. FIG. 5 is a sectional view showing a state prior to the coupling of the female connector and male connector. FIG. 9 is a disassembly perspective view of a vehicle door employing the same connector coupling structure. FIG. 10 is an explanatory diagram showing a state prior to installation of the female connector and male connector having the connector coupling structure employed in the same vehicle door.

As shown in FIGS. 3, 10, of the male connector 20 and female connector 30 both made of synthetic resin, the male connector (one connector of them) 20 is to be installed on a door panel (mounting base) 50 through a holder 10 made of synthetic resin such that it projects from the door panel 50. The female connector 30 (other connector) remains capable of being freely coupled with the male connector 20 projected from this holder 10. This female connector 30 is installed on a switch 41 of a switch unit 40 such as a power window switch unit or the like through a substrate (not shown). The switch unit 40 is to be installed on a switch mounting hole (switch mounting portion) 61 formed on a door trim (other mounting base) 60.

Figure 6:
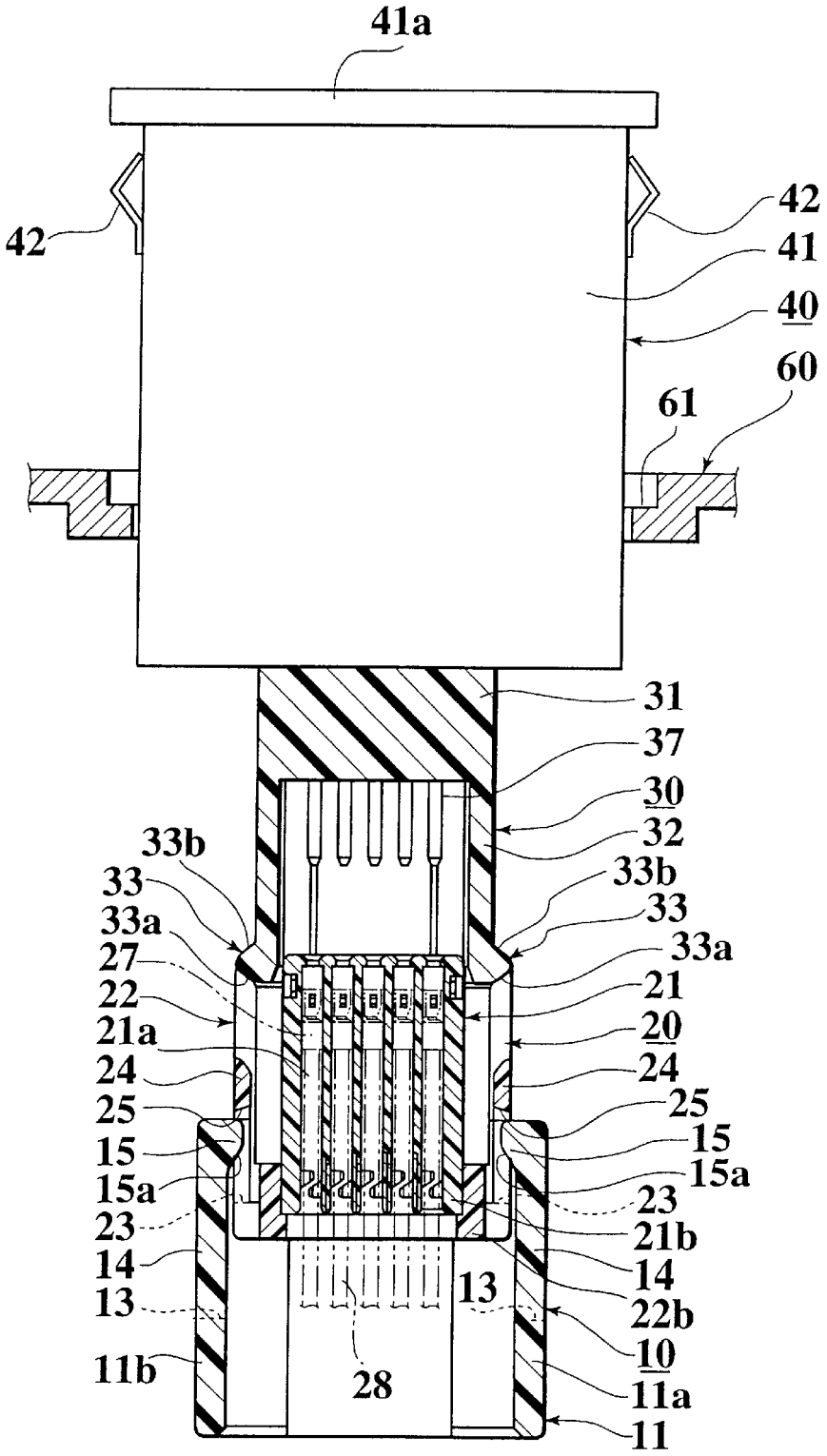
FIG. 6 is a sectional view showing a state of the initial period of the coupling of the connectors of FIG. 3.

As shown in FIGS. 3, 5, 6, the holder 10 comprises a cylindrical body 11 formed in the shape of a substantially rectangular cylinder with upper and lower walls 11*a*, 11*b* and left and right side walls 11*c*, 11*d* and a mounting bracket 12 formed integrally with the lower wall 11*b* of this cylindrical body so as to project therefrom. Each of the left side wall 11*c* and right side wall 11*d* has a pair of slits 13, 13 provided in the center thereof and a L-shaped flexible arm (engaging means) 14 is formed between the pair of the slits 13 and 13 so as to project therefrom. As shown in FIG. 6, a protrusion (engaging portion) 15 having a trapezoidal section is formed inside of a front end of each of the pair of the flexible arms (engaging means) 14, 14 so as to project therefrom. A rear portion of each protrusion 15 has a tapered face 15*a*.

As shown in FIG. 5, in the center of the front end of the inside faces of the upper wall 11*a* and lower wall 11*b* of the cylindrical body 11 of the holder 10 are formed a pair of stoppers 16, 16 for restricting an amount of projection of the male connector 20 forward integrally with both the walls such that they project therefrom. A clearance is provided on the entire circumference between the cylindrical body 11 of the holder 10 and the hood 22 of the male connector 20 which will be described later, so that the hood 22 of the male connector 20 is supported freely slidably within the cylindrical body 11 of the holder 10. That is, when the coupling of the male connector 20 and female connector 30 is completed, both the connectors 20, 30 are freely slidable downward of the door panel 50 with respect to the cylindrical body 11 of the holder 10 in the coupling completion condition.

Figure 4:
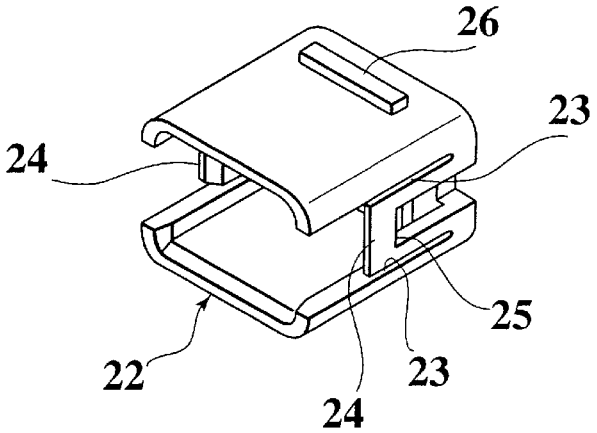
FIG. 4 is a perspective view of a hood of the male connector of FIG. 3.

As shown in FIGS. 3, 5 to 8, the male connector 20 comprises a housing 21 containing a plurality of terminal accommodating chambers 21*a* for accommodating a female terminal (terminal) 27 and a hood 22 for covering this housing 21. A base portion 21*b* of this housing 21 is installed in a base portion 22*b* of the hood 22 by pressure insertion such that it is centered by the base portion 22*b* of the hood 22. As shown in FIGS. 3, 4, the hood 22 is formed in the shape of a substantially rectangular cylinder with the upper and lower walls and left and right side walls and acts to guide for the holder 10 and female connector 30. In the center of each of the left and right side walls of the substantially rectangular cylindrical hood 22 are formed a pair of slits 23, 23 and a flexible engaging piece (engaging means) 24 of a U-shape is formed integrally with each side wall between the pair of the slits 23 and 23 so that it is fit to and released from the protrusion 15 of each flexible arm 14 of the holder 10. The width of this flexible engaging piece 24 is set so as to be larger than the width of the protrusion 15 of each flexible arm 14 of the holder 10 and each of the flexible engaging pieces 24 is freely contactable with the left side wall 11*c* and right side wall 11*d* in the vicinity of each flexible arm 14 of the cylindrical body 11 of the holder 10.

When as shown in FIG. 6, when the protrusion 15 of each flexible arm 14 of the holder 10 engages with an engaging hole 25 of each flexible engaging piece 24 of the hood 22 of the male connector 20, the male connector 20 waits for the female connector 30 to be fit thereto while being projected a predetermined length from the holder 10. That is, because the protrusion 15 of each flexible arm 14 of the holder 10 engages with the engaging hole 25 of each flexible engaging piece 24 of the hood 22 of the male connector 20, the retraction of the male connector 20 with respect to the holder 10 is restricted. When the male connector 20 is at this projected waiting position, both the connectors 20, 30 can be fit to or released from each other. As shown in FIGS. 4, 5, in the center of a bottom side of each of the vertical walls of the hood 22 of the male connector 20 is formed a stopper receiving portion 26 integrally therewith such that they project therefrom. When the protrusion 15 of each flexible arm 14 of the holder 10 engages with the engaging hole 25 of each flexible engaging piece 24 of the hood 22 of the male connector 20, each stopper receiving portion 26 of the hood 22 of the male connector 20 engages with each stopper 16 of the cylindrical body 11 of the holder 10 so that the forward projection of the male connector 20 is restricted. As shown in FIGS. 5 to 9, wire 28 constituting wire harness W is connected by pressure welding or crimping to a rear end of each female terminal 27 of the housing 21 of the male connector 20.

As shown in FIGS. 3, 6 to 8, the female connector 30 has a base portion 31 structured in the form of blocks including a plurality of terminal accommodating chambers 31*a* for accommodating male terminals (terminals) 37. Its front portion is a hood portion 32 of a rectangular cylinder which is formed integrally with the base portion 31 and in which respective male terminals 37 are exposed. When both the connectors 20, 30 are fit to each other, the hood portion 32 of the female connector 30 is inserted in between the housing 21 and hood 22 of the male connector 20 so that the terminals 27, 37 of the respective connectors 20, 30 are electrically connected to each other. Further, in the center of the front side of the outer surface of each of both sides of the hood portion 32 of the female connector 30 is formed a protrusion 33 integrally therewith, which acts as a holding means for holding the engagement between the protrusion 15 of each flexible arm 14 of the holder 10 and the engaging hole 25 of each flexible engaging piece 24 of the male connector 20 and as a holding releasing means for releasing the engagement between the protrusion 15 of each flexible arm 14 of the holder 10 and the engaging hole 25 of each flexible engaging piece 24 of the male connector 20 when the coupling of both the connectors 20 and 30 is completed or both the connectors are uncoupled from each other at the same time. This protrusion 33 is formed substantially in the shape of a triangle and a front side thereof is a tapered face (engaging face) 33*a* and a rear side thereof is also a tapered face (releasing face) 33*b*.

Figure 8:
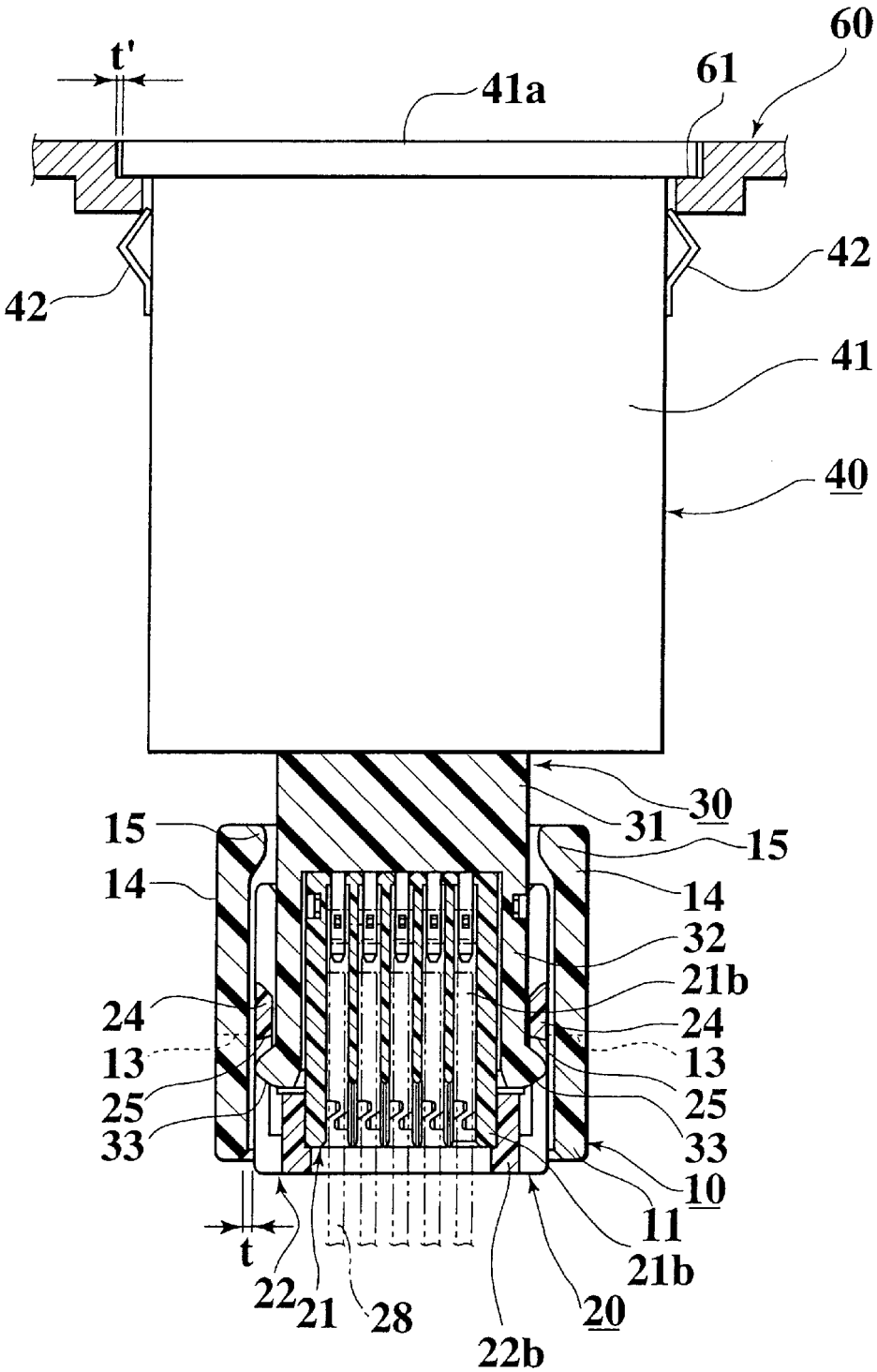
FIG. 8 is a sectional view showing a state in which the coupling of the connectors of FIG. 3 is completed.

As shown in FIGS. 6, 8 to 12, a switch unit 40 comprises a switch 41, the female, connector 30 fixed to this switch 41 through a substrate or the like (not shown) and leaf springs 42 (locking means) of V-shaped metal each which is fixed to a top side of each of both sides of the aforementioned switch 41 by screwing or the like for locking the switch 41 mounted in a switch mounting hole 61 of the door trim (other mounting base) 60. As shown in FIG. 8, a mounting clearance t' between the switch 41 of the switch unit 40 and the switch moupting hole 61 of the door trim 60 is set so as to be smaller than a clearance t between the cylindrical body 11 of the holder 10 and hood 22 of the male connector 20 (t>t'). Further, as shown in FIG. 9, a waterproof sheet 51 is bonded to the door panel 50.

According to the connector coupling structure of this embodiment, as shown in FIG. 9, when the male connector 20 of the wire harness W placed on the door panel 50 is connected to the female connector 30 of the switch unit 40 to be mounted on the door panel 50 through a door trim 60, first a waterproof sheet 51 is stretched over the door panel 50 and then the wire harness W is placed over the waterproof sheet 51 on the door panel 50. Then, the door trim 60 is installed on the door panel 50 in which the wire harness is placed. Then, the female connector 30 of the switch unit 40 is installed in the switch mounting hole 61 of the door trim 60 and finally, the female connector 30 is fit to the male connector 20 connected to an end of the wire harness W.

Figure 7:
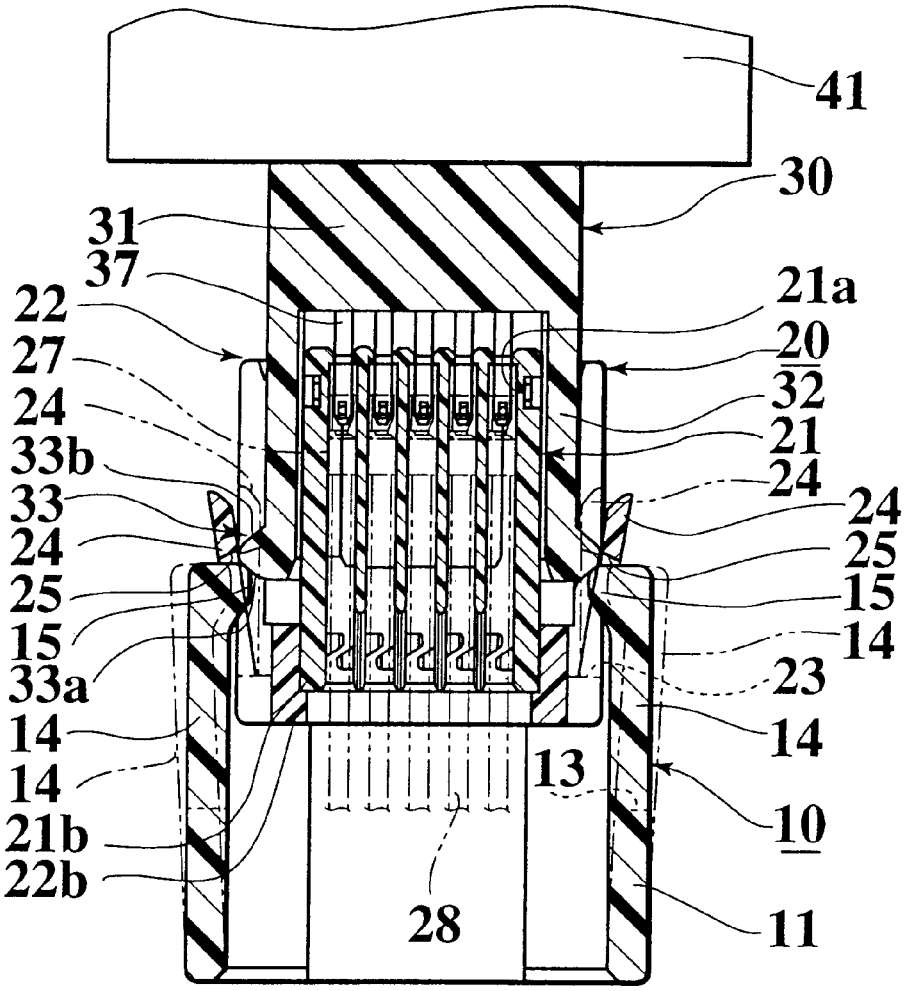
FIG. 7 is a sectional view showing a state on halfway of the coupling of the connectors of FIG. 3.
Figure 11:
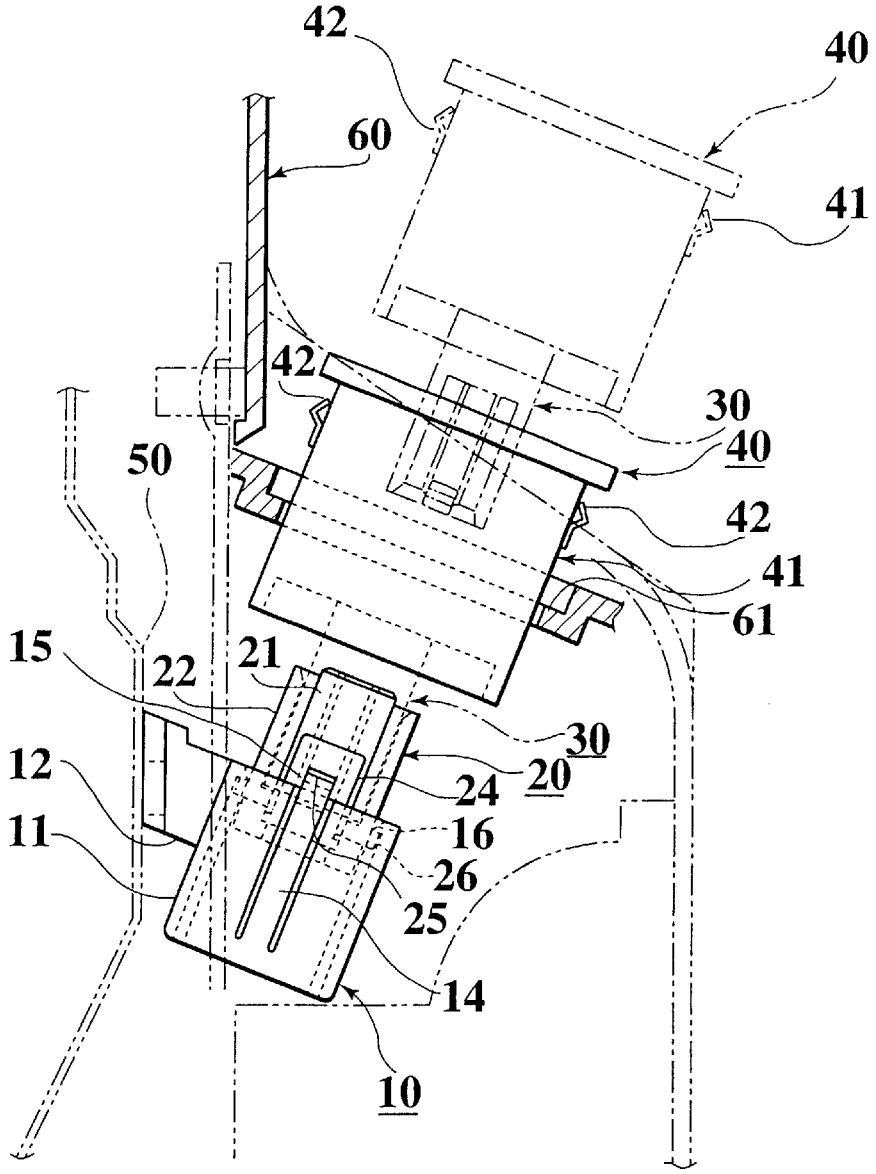
FIG. 11 is an explanatory view of the state in which the coupling of the connectors of FIG. 10 is completed.
Figure 12:
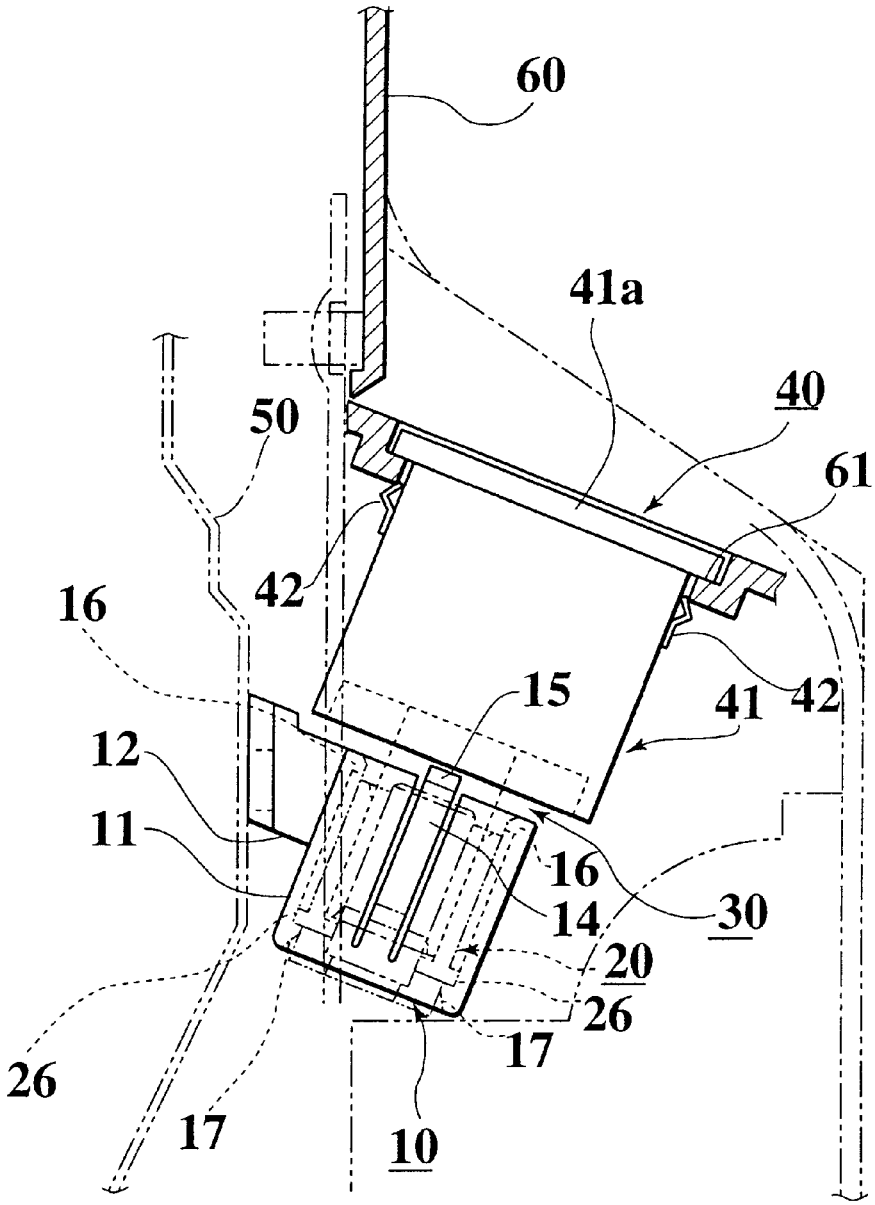
FIG. 12 is an explanatory view showing a state in which the installation of the vehicle door switch is completed.

In this case, as shown in FIGS. 10 to 12, the male connector 20 of the wire harness W is installed on the door panel 50 through the holder 10 of the male connector 20 and the male connector 20 is kept in a waiting position such that it projects toward the switch mounting hole 61 of the door trim 60. When the switch unit 40 is installed in the switch mounting hole 61, the female connector 30 of the switch unit 40 is fit to the male connector 20 of the wire harness W. The coupling of both the connectors 20 and 30 will be described with reference to FIGS. 6 to 8. In the initial state of the coupling of the male connector 20 and female connector 30 as shown in FIG. 6, the projected waiting condition of the male connector 20 is held by the engagement between the protrusion 15 of each flexible arm 14 of the holder 10 and the engaging hole 25 of each flexible engaging piece 24 of the male connector 20. In the halfway process of the coupling of the male connector 20 and female connector 30 as shown in FIG. 7, each of the flexible engaging piece 24 of the male connector 20 is elastically deformed outward by a pressing force of each protrusion 33 of the female connector 30 so that the engagement between the protrusion 15 of each flexible arm 14 of the holder 10 and the engaging hole 25 of each flexible engaging piece 24 of the male connector 20 is securely maintained.

If the coupling of both the connectors 20 and 30 is completed as shown in FIG. 8, each protrusion 33 of the female connector 30 enters the engaging hole 25 of each flexible engaging piece 24 of the male connector 20. At this time, the tapered face 33*a* of each protrusion 33 of the female connector 30 presses the protrusion 15 of each flexible arm 14 of the holder 10 outward so that each of the flexible arms 14 is elastically deformed outward. As a result, the engagement between the protrusion 15 of each flexible arm 14 of the holder 10 and the engaging hole 25 of each flexible engaging piece 24 of the male connector 20 is released, so that both the connectors 20, 30 coupled with each other slide together downward in the holder 10.

If this slide is completed, the switch 41 installed in the switch mounting hole 61 of the door trim 60 is locked by an elastic urging force of the leaf spring 42 as shown in FIG. 8, so that the installation of the switch unit 40 to the door panel 50 is completed.

At this time, both the connectors 20, 30 coupled with each other are locked by the engagement between the engaging hole 25 of each flexible engaging piece 24 of the male connector 20 and each protrusion 33 of the female connector 30. Further, each flexible engaging piece 24 of the male connector 20 is freely contactable with the left side wall 11*c* and right side wall 11*d* and the width of each flexible engaging piece 24 of the male connector 20 is set so as to be larger than the width of the protrusion 15 of the flexible arm 14 of the holder 10. Therefore, even if the wire harness connected to the male connector 20 is pulled for some reason after both the connectors 20, 30 are coupled with each other, the coupling of the connectors 20, 30 is never lost.

If the switch 41 of the switch unit 40 is pulled upward as shown in FIG. 7 when both the connectors 20, 30 are released from the coupling condition thereof shown in FIG. 8 for maintenance and inspection, the tapered face 33*b* of each protrusion 33 of the female connector 30 presses the protrusion 15 of each flexible arm 14 of the holder 10 outward so that each flexible arm 14 is deflected outward. As a result, each flexible engaging piece 24 of the male connector 20 is exposed from the holder 10, so that the protrusion 15 of each flexible arm 14 of the holder 10 engages with the engaging hole 25 of each flexible engaging piece 24 of the male connector 20 (this position is the same position as the projected waiting position of the male connector 20 prior to the fitting). Then, by pulling the switch 41 of the switch unit 40 further upward, the female connector 30 is released from the male connector 20 smoothly. If the female connector 30 is coupled with the male connector 20 again after the maintenance and inspection is completed also, because the male connector 20 is located at the projected waiting position which is projected with respect to the holder 10, it is easy to fit the female connector 30 to the male connector 20.

According to the present embodiment, the male connector 20 is provided on the holder 10 slidably relative thereto and after the female connector 20 is coupled with the male connector 20, both the connectors 20, 30 are capable of sliding relative to the holder 10 downward of the door panel 50. Therefore, both the connectors 20, 30 can be coupled with each other easily thereby improving work efficiency. Further, it is not necessary to pull out each wire constituting the wire harness W, and therefore catching of the wire 28 can be prevented thereby preventing a connection failure and disconnection of the wire 28 and the like.

Because the holder 10 is formed in the rectangular cylindrical shape and the connectors 20, 30 coupled with each other are provided slidably in this rectangular cylindrical holder 10, the connectors 20, 30 coupled with each other can be slid linearly downward of the door panel 50, so that the installation time of the connectors to the door panel 50 can be largely reduced. Further, because the switch 41 installed to the female connector 30 is installed in the switch mounting hole 61 provided in the door trim 60 such that the switch 41 installed to the switch mounting hole 61 can be freely locked by means of the leaf spring 42, installation looseness of the connectors 20, 30 between the door panel 50 and door trim 60 can be absorbed thereby preventing an occurrence of abnormal noise due to vibration or the like.

Further, by providing a clearance t between the holder 10 and the male connector 20, the male connector 20 is provided in the holder 10 slidably relative thereto, so that both the connectors 20, 30 coupled with each other are capable of sliding relative to the holder 10 toward the door panel 50 in the coupling completion condition. Thus, both the connectors 20, 30 are aligned with each other and coupled with each other smoothly. Further, both the connectors 20, 30 are slid easily relative to the holder 10 in the coupling completion condition and installed to the door panel 50. As a result, vibration and the like are prevented thereby improving anti-vibration performance and preventing an occurrence of abnormal noise. Because the switch 41 installed to the female connector 30 is installed to the switch mounting hole 61 provided in the door trim 60 and the clearance t' between the switch mounting hole 61 and switch 41 is set so as to be larger than the clearance t between the holder 10 and male connector 20, the installation error between the door panel 50 and door trim 60 is absorbed when the sliding of both the connectors 20, 30 in the coupling completion condition ends, so that there never occurs a looseness or vibration of both the connectors 20, 30 thereby preventing an occurrence of abnormal noise.

Further because the hood 22 of the male connector 20 is formed in the substantially rectangular cylindrical shape and acts as a guide for the holder 10 and female connector 30, the female connector 30 slides smoothly relative to the male connector 20 so that both the connectors 20, 30 are coupled with each other accurately and the coupled connectors 20, 30 slide smoothly relative to the holder 10. Consequently, vibration and the like are prevented improving anti-vibration performance, thereby preventing an occurrence of abnormal noise. Further, the male connector 20 is constituted with the housing 21 and substantially rectangular cylindrical hood 22, many connector housings using a pressure welding terminal, crimping terminal or the like can be used at the same time, thereby improving general purpose usability.

Thus, the engagement between the flexible arm 14 of the holder 10 and the flexible engaging piece 24 of the male connector is maintained securely until the coupling of both the connectors 20, 30 is completed by the protrusion 33 of the female connector 30, the coupling of both the connectors 20, 30 can be ensured thereby improving the reliability. Further, when both the connectors 20, 30 are coupled with each other, the engagement between the flexible arm 14 of the holder 10 and the flexible engaging piece 24 of the male connector 20 is released by the protrusion 33 of the female connector 30. Therefore, it can be confirmed that the coupling of both the connectors 20, 30 is completed when both the connectors 20, 30 slide relative to the holder 10, so that the coupling of both the connectors 20, 30 can be confirmed easily. Therefore, both the connectors 20, 30 can be aligned with each other and coupled with each other smoothly and both the connectors 20, 30 can be slid relative to the holder 10 easily in the coupled condition and installed to the door panel 50. As a result, vibration and the like can be prevented improving anti-vibration performance thereby preventing an occurrence of abnormal noise. Further where the sliding of both the connectors 20, 30 in the coupling completion condition relative to the holder 10 is completed, an installation error between the door panel 50 and door trim 60 can be absorbed, so that looseness and vibration of both the connectors 20, 30, abnormal noise and the like can be prevented excellently.

Further, because the retraction position of the male connector 20 at the projected waiting position is restricted by the engagement between the protrusion 15 of the flexible arm 14 of the holder 10 and the engaging hole 25 of the flexible engaging piece 24 of the male connector 20, both the connectors 20, 30 can be coupled with each other easily. Further, because the flexible arm 14 of the holder 10 and the flexible engaging piece 24 of the male connector 20 are disposed at the same position and the holding means and holding releasing means of the female connector 30 are constituted with the same protrusion 33, the size of the entire connector can be reduced. Further because the forward waiting position of the male connector 20 is restricted by the engagement between the stopper 16 of the holder 10 and stopper receiving portion 26 of the male connector 20, the coupling position and uncoupling position of both the connectors 20, 30 can be always set to the same position, so that the uncoupling of both the connectors 20, 30 for maintenance and inspection and coupling thereof again can be carried out easily.

Although according to the present embodiment, the forward projected waiting position of the male connector 20 relative to the holder 10 is restricted by the engagement between the stopper 16 at the front portion of the holder 10 and stopper receiving portion 26 at the rear portion of the male connector 20, the retraction position of the male connector 20 relative to the holder 10 may be restricted by the engagement between the stopper 17 at the rear portion of the holder 10 and the stopper receiving portion 26 at the rear portion of the male connector 20 as shown in FIG. 12.

Although in the present embodiment, the metallic leaf spring is used as the locking means, the locking means may be constituted with other elastically deformable member. Meanwhile, the connector coupling structure can be applied to other fields than vehicle door.

A connector coupling structure according to another embodiment of the present invention will be described with reference to FIGS. 13 to 20.

As shown in FIGS. 13 to 20, of male and female connectors 80, 90 of synthetic resin, the male connector (one connector) 80 is installed on the door panel (mounting base) 50 in such a condition that it is projected through a holder 70 of synthetic resin. The female connector (other connector) 90 is capable of being coupled with or uncoupled from the male connector 80 projected from the holder 70 in the waiting condition. This female connector 90 is installed to the switch 41 of the switch unit 40 like power window switch unit through a substrate and the switch unit 40 is installed in a switch mounting hole (switch mounting portion) 61 formed on a door trim (other mounting base) 60.

Figure 13:
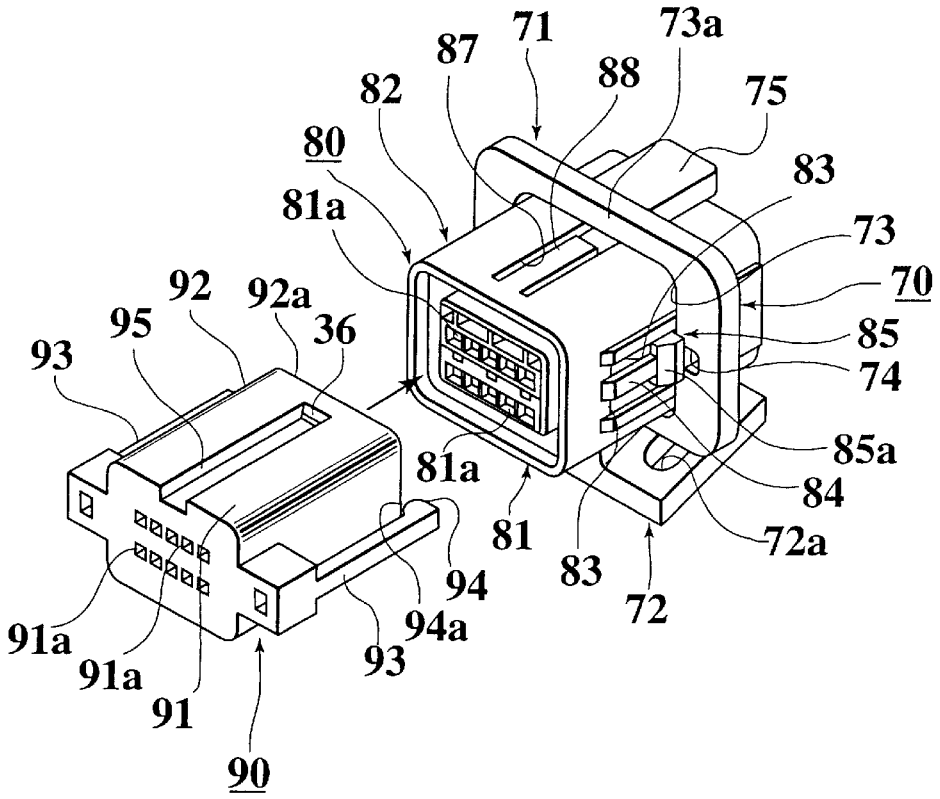
FIG. 13 is a perspective view showing a state prior to the coupling of the female and male connectors in a connector coupling structure according to another embodiment of the present invention.
Figure 14:
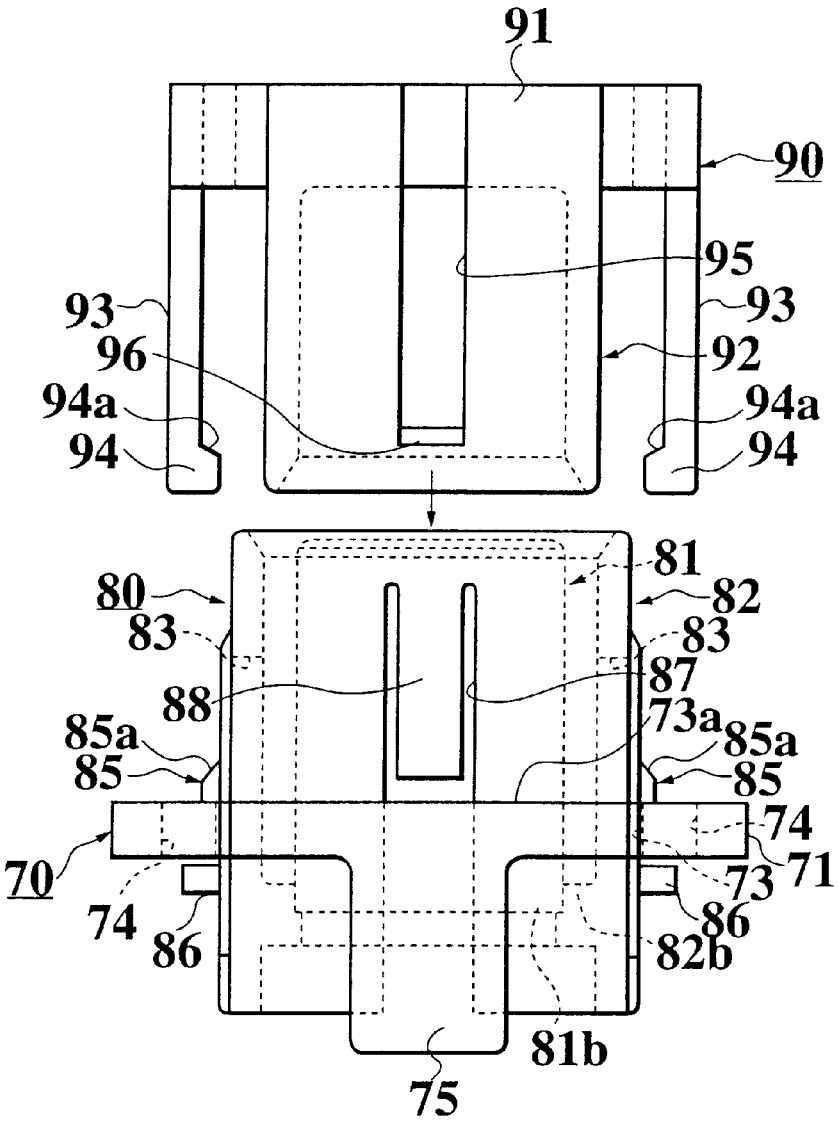
FIG. 14 is a plan view showing a state prior to the coupling of the connectors of FIG. 13.
Figure 15:
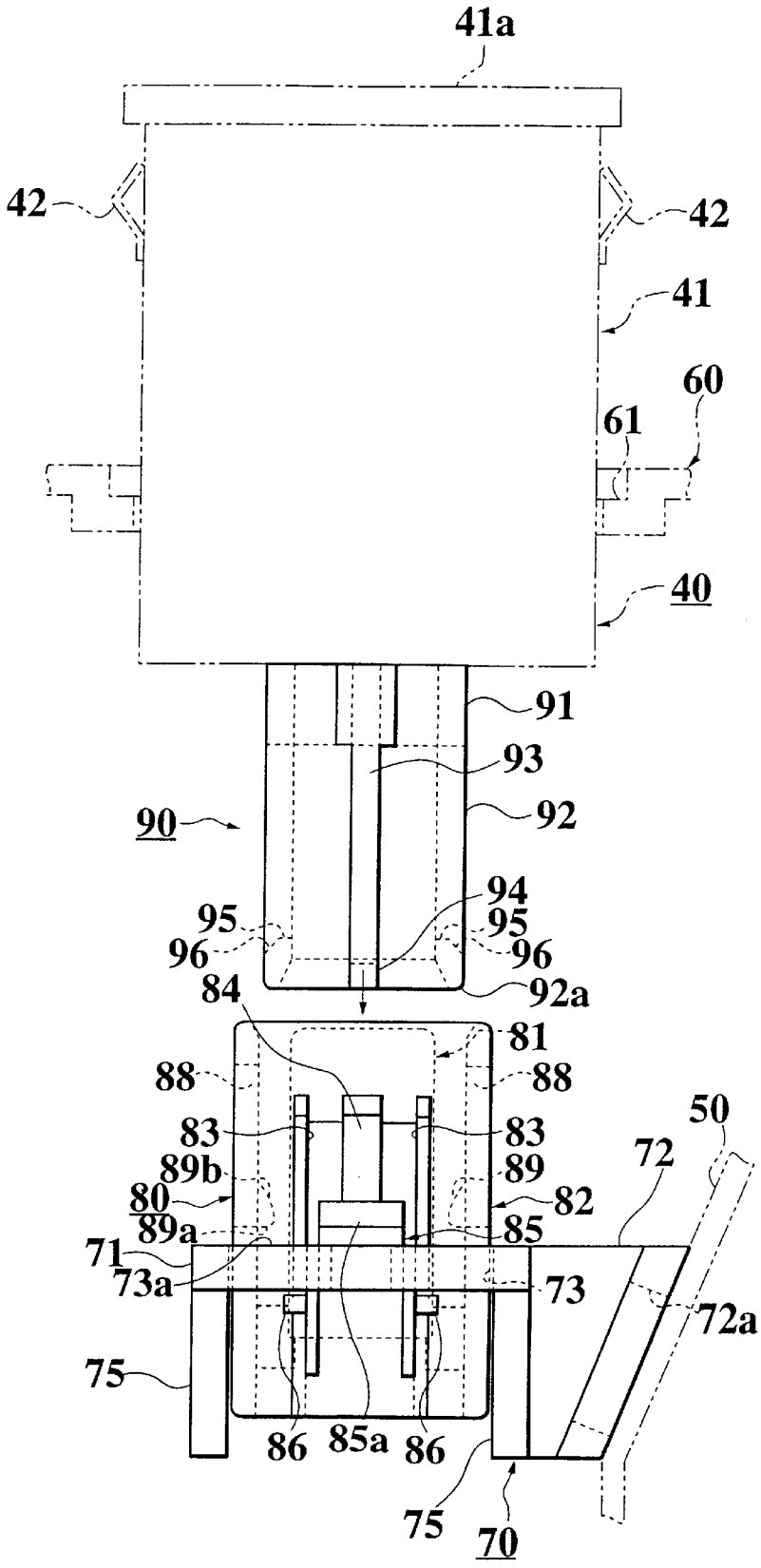
FIG. 15 is a side view showing a state prior to the coupling of the connectors of FIG. 13.

As shown in FIGS. 13 to 15, the holder 70 comprises a plate body 71 having a substantially rectangular engagement hole (engaging means) 73 provided in the center of that substantially rectangular plate body and a mounting bracket 72 formed integrally with the plate body 71 so as to project from the center of the bottom portion thereof. An engaging concave portion 74 is formed in the center of each of left and right sides of a peripheral wall 73*a* of the engagement hole 73 of the plate body 71. A pair of long projecting pieces 75, 75 extending backward are formed integrally with the peripheral wall 73*a* so as to project therefrom in the center of each of upper and lower portions of back portion of the peripheral wall 73*a* of the engagement hole 73 of the plate body 71. Further, a clearance is provided entirely between the peripheral wall 73*a* of the engagement hole 73 of the plate body 71 and the hood 82 of the male connector 80, so that the hood 82 of the male connector 80 is supported slidably within the engagement hole 73 of the plate body 71 of the holder 70. That is, the male connector 80 and female connector 90 are supported slidably in the coupling completion condition downward of the door panel 50 relative to the engagement hole 73 of the plate body 71 of the holder 70.

As shown in FIG. 13, the male connector 80 comprises a housing 81 having a plurality of terminal accommodating chambers 81*a* for accommodating female terminals (terminal) (not shown) and a hood 82*b* for covering this housing 81. A base portion 81*b* of this housing 81 is assembled into a base portion 82*b* of the hood 82 by pressing or the like such that it is aligned therewith. As shown in FIGS. 13, 14, the hood 82 is formed in the shape of a substantially rectangular cylindrical shape with upper and lower walls and left and right side walls and acts as a guide for the holder 70 and female connector 90. A pair of long holes 83, 83 are formed in the center of each of the left and right side walls of this substantially rectangular cylindrical hood 82. A flat T-letter shaped flexible arm (engaging means) 84 having an protrusion (engaging portion) 85 which is fit to or released from each concave portion 74 in the peripheral wall 73*a* of the engaging hole 73 of the plate body 71 of the holder 70 is formed between each pair of the long holes 83, 83. The protrusion 85 is formed integrally with the flexible arm 84 so as to project therefrom so that the width of the protrusion 85 of each flexible arm 84 is larger than the width of the engaging concave portion 74 in the plate body 71 of the holder 70. Each protrusion 85 is formed in a trapezoidal section and a tapered face 85*a* is formed on a front portion of each protrusion 84.

As shown in FIGS. 14, 15, when each engaging concave portion 74 of the engaging hole 73 of the plate body 71 of the holder 70 engages with the protrusion 85 of each flexible arm 84 of the hood 82 of the male connector 80, the male connector 80 waits for the female connector 90 to be coupled therewith such that it projects from the holder 70 at a predetermined distance. That is, the retraction of the male connector 80 relative to the holder 70 is restricted by engagement between each engaging concave portion 74 of the engaging hole 73 of the plate body 71 of the holder 70 and the protrusion 85 of each flexible arm 84 of the hood 82. The projected waiting condition of the male connector 80 provided when this engagement is attained is a position for coupling or uncoupling both the connectors 80, 90. As shown in FIGS. 14, 15, in the vicinity of a rear portion of the long hole 83 in each of the left and right side walls of the hood 82 of the male connector 80 are formed a pair of stoppers 86 integrally therewith. Then, the rear portion of the peripheral wall 73*a* of the engaging hole 73 of the plate body 71 of the holder 70 engages with each stopper 86 of the hood 82 of the male connector 80 so as to restrict the forward projection amount of the male connector 80. Further, wire (not shown) constituting the wire harness W is connected by pressure welding or crimping to a rear portion of each female terminal (not shown) of the housing 81 of the male connector 80.

As shown in FIGS. 13, 14, a U-shaped cutout 87 is formed in the center of each of the upper and lower side walls of the substantially rectangular cylindrical hood 82 of the male connector 80. Within each of the cutouts 87 is formed a rectangular plate-like flexible engaging piece (engaging means) 88 having a protrusion (engaging portion) 89 to be fit to or released from a front end portion 92*a* of the hood 92 of the female connector 90, integrally therewith. Each flexible engaging piece 88 is disposed at a position opposing each long projecting piece 75 of the holder 71. A front portion of the protrusion 89 of each flexible engaging piece 88 is a tapered face (engaging face) 89*a* and a rear portion thereof is also a tapered face (releasing face) 89*b*.

Figure 16:
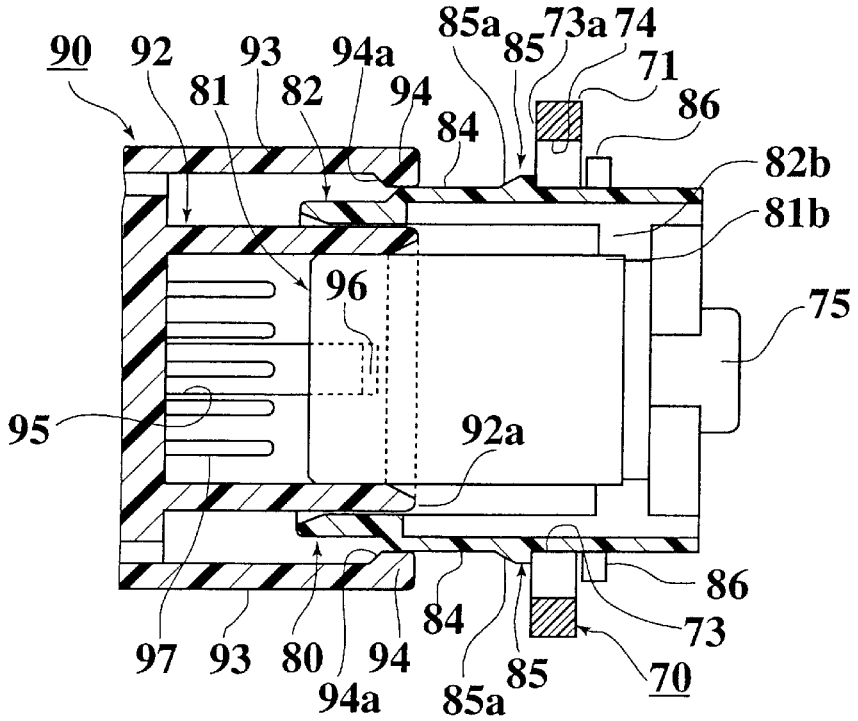
FIG. 16 is a lateral sectional view showing a state of the initial period of the coupling of the connectors of FIG. 13.
Figure 17:
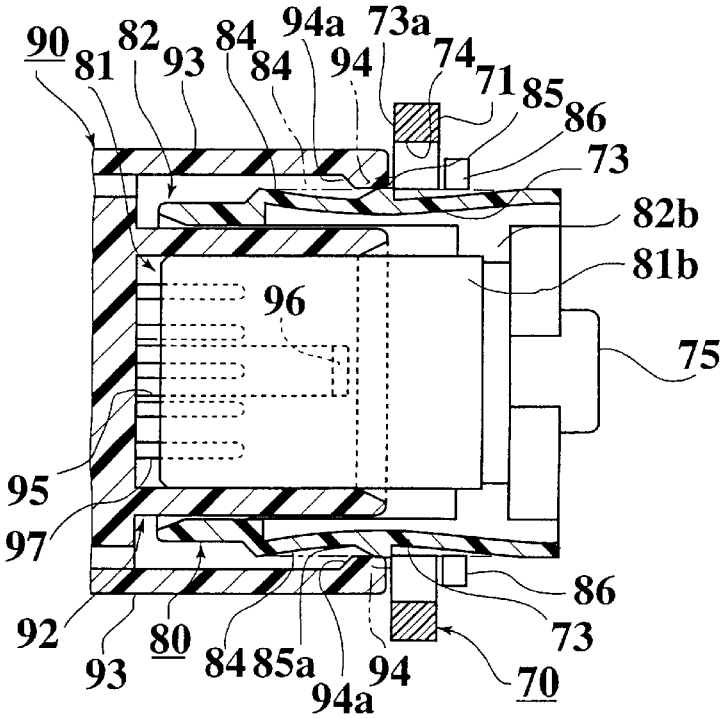
FIG. 17 is a lateral sectional view showing a state on halfway of the coupling of the connectors of FIG. 13.
Figure 18:
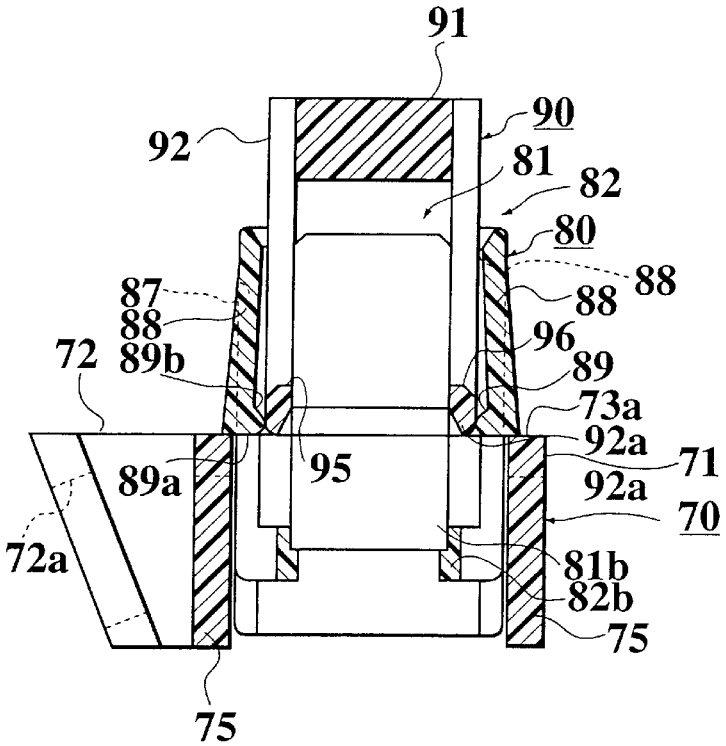
FIG. 18 is a longitudinal sectional view showing a state of the initial period of the coupling of the connectors of FIG. 13.
Figure 19:
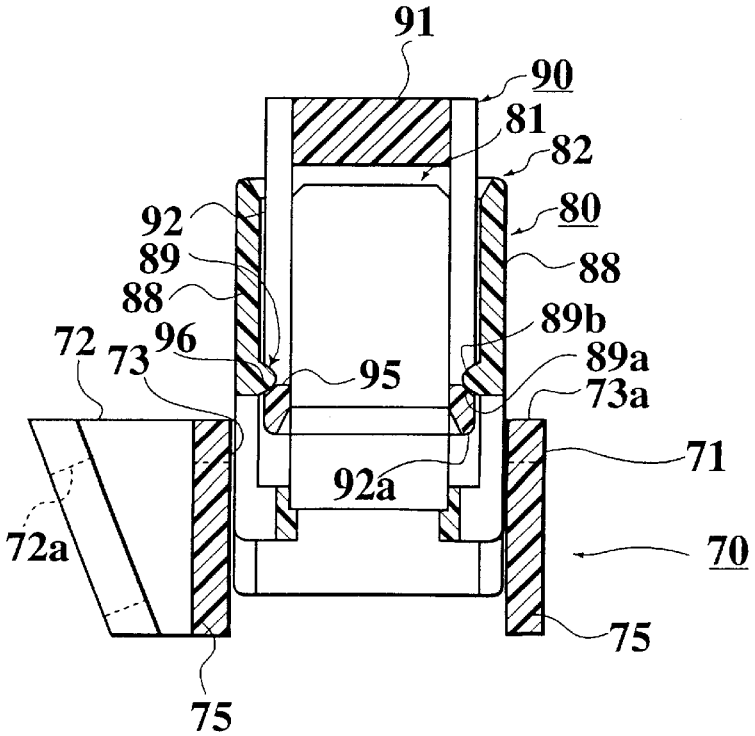
FIG. 19 is a longitudinal sectional view showing a state in which the coupling of the connectors of FIG. 13 is completed.

As shown in FIGS. 13, 16, 17, the female connector 90 includes a base portion 91 formed in a block shape having a plurality of terminal accommodating chambers 91*a* for accommodating the male terminals (terminals) and a front portion thereof is a rectangular cylindrical hood portion 92 which is formed interaglly with the base portion 91 so as to project therefrom and in which male terminals 97 are exposed. When both the connectors 80, 90 are coupled with each other, the hood portion 92 of the female connector 90 is inserted in between the housing 81 of the male connector 80 and hood 82, so that the terminals of both the connectors 80, 90 are electrically connected to each other. In the center of an outside surface of both sides of the base portion 91 of the female connector 90 is formed a flexible releasing arm (holding releasing means) 93 having a protrusion 94 for releasing the engagement between each engaging concave portion 74 of the engaging hole 73 of the plate body 71 of the holder 70 and the protrusion 85 of each flexible arm 84 such that it extends in parallel to the hood portion 92, integrally therewith. The protrusion 94 of this releasing arm 93 warps the flexible arm 84 and is formed in a trapezoidal section. A rear portion of each protrusion 94 is a tapered face (releasing face) 94*a*. The projected waiting condition of the male connector 80 is maintained by the engagement between the protrusion 85 of the flexible arm 84 of the male connector 80 and the engaging concave portion 74 of the engaging hole 73 of the holder 70. Then, the engagement between the protrusion 85 of the flexible arm 84 and the engaging concave portion 74 of the engaging hole 73 of the holder 70 is released by the protrusion 94 of the flexible releasing arm 93 of the female connector 90, so that the protrusion 94 of the releasing arm 93 passes through the engaging concave portion 74 of the engaging hole 73, thereby releasing the projected waiting condition of the male connector 80.

The hood (holding means) 92 of the female connector 90 is formed in a substantially rectangular cylindrical shape and a front end portion 92*a* thereof comes into contact with and presses the protrusion 89 of each flexible engaging piece 88 of the male connector 80 when the male connector 80 and female connector 90 are coupled with each other so as to warp the flexible engaging piece 88 outward, thereby functioning as a holding means for holding the engagement between the holder 70 and male connector 80. In the center of the upper and lower wall portions of the hood portion 92 of the female connector 90 is formed a rectangular groove hole (releasing concave portion) 95 into which the protrusion 89 of the flexible engaging piece 88 is to be inserted, acting as a holding releasing means for releasing the engagement between the holder 70 and male connector 80. A tapered face (releasing portion) 96 is formed between the hood portion 92 and a front end portion of the groove hole 95.

Figure 20:
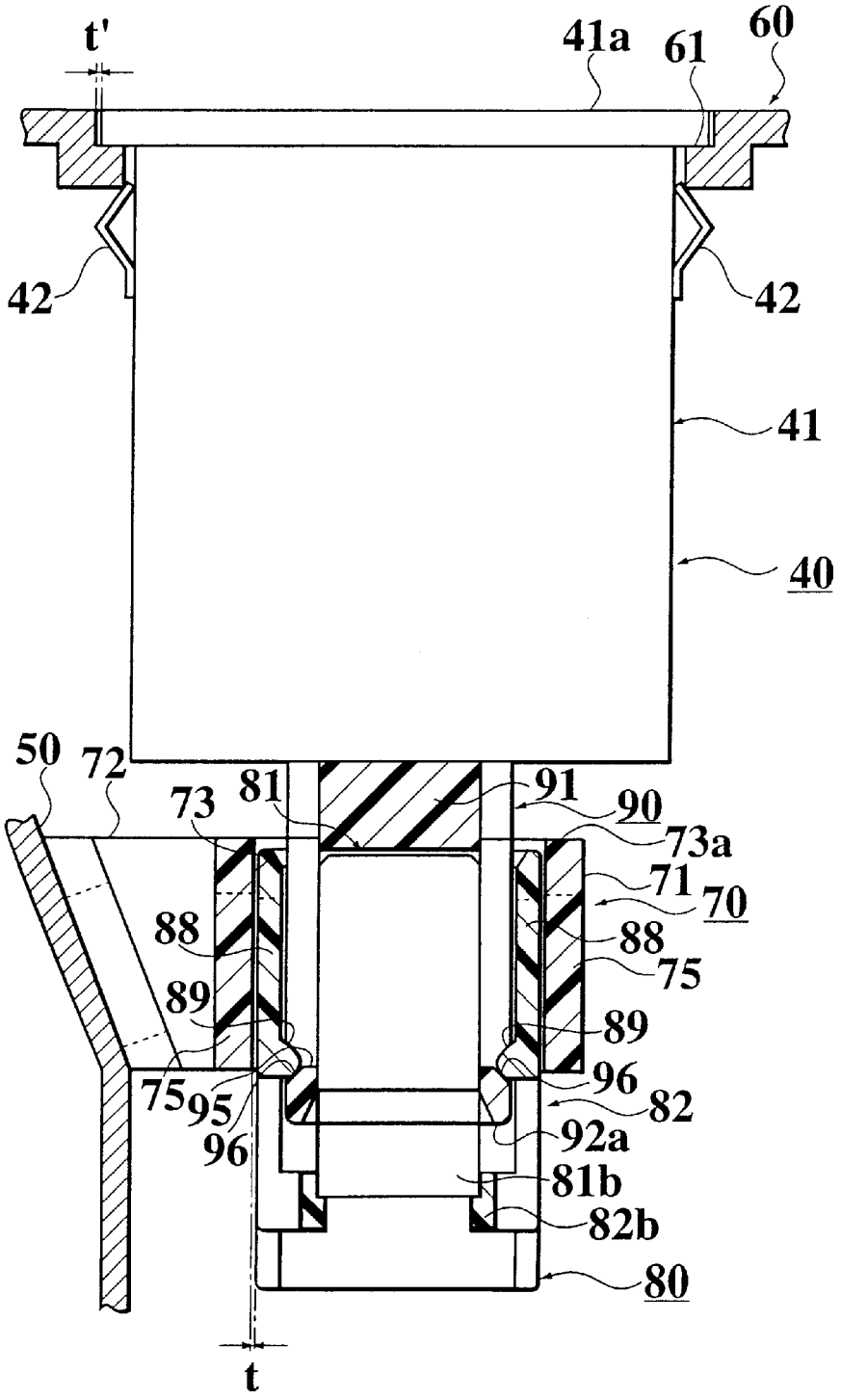
FIG. 20 is a longitudinal sectional view showing a state in which the installation of the connectors of FIG. 13 is completed.

As shown in FIGS. 15, 20, the switch unit 40 comprises the switch 41, the female connector 90 fixed to this switch 41 through a substrate or the like (not shown) and metallic V-shaped leaf springs (locking means) 42 which are installed on a upper portion of both side walls of the switch 41 by screwing or the like for locking the switch 41 installed in the switch mounting hole 61 of the door trim (other mounting base) 60 in the door trim 60. A clearance t between the plate body 11 of the holder 10 and the hood 82 of the male connector 80 is set so as to be larger than a clearance t' between the switch 41 of the switch unit 40 and the switch mounting hole 61 of the door trim 60 as shown in FIG. 20 ($t>t'$).

The clearance t is provided between the holder 70 and male connector 80 such that the male connector 80 is slidable relative to the holder 70. When the coupling of the male connector 80 and female connector 90 is completed, both the connectors 80, 90 in the coupling completion condition are freely slidable relative to the holder 70 toward the door panel 50. Therefore, like the previously described embodiment, both the connectors 80, 90 are aligned with each other and coupled with each other smoothly. Further, both the connectors 80, 90 in the coupling completion condition are slid easily relative to the holder 70 and installed to the door panel. As a result, vibration and the like are prevented improving anti-vibration performance thereby preventing an occurrence of abnormal noise. Because the switch 41 installed on the female connector 90 is installed in the switch mounting hole 61 provided in the door trim 60 and the clearance t between the holder 70 and male connector 80 is set so as to be larger than the clearance t' provided between the switch mounting hole 61 and switch 41, the installation error between the door panel 50 and door trim 60 is absorbed where the sliding of both the connectors 80, 90 in the coupling completion condition ends, thereby preventing looseness and vibration of both the connectors 80, 90 and an occurrence of abnormal noise.

According to the present embodiment also, because the hood 82 of the male connector 80 is provided on the holder 70 slidably relative thereto, the sliding performance of the male connector 80 relative to the holder 70 is improved. Further, because the hood 82 of the male connector 80 is formed in the substantially rectangular cylindrical shape and acts as a guide for the holder 70 and female connector 90, the female connector 90 slides smoothly relative to the male connector 80 so that both the connectors 80, 90 are coupled with each other securely and the coupled connectors 80, 90 slide smoothly relative to the holder 70. Consequently, vibration and the like are prevented improving the anti-vibration performance thereby preventing an occurrence of abnormal noise. Further, because the male connector 80 comprises the housing 81 and substantially rectangular cylindrical hood 82, many connector housings using the pressure welding terminal, crimping terminal or the like can be used at the same time thereby improving general purpose usability.

While preferred embodiments of the present invention have been described using specific terms, such description is for illustrative purposes, and it is to be understood that changes and variations may be made without departing from the spirit or scope of the following claims.

What is claimed is:

1. A connector coupling structure comprising a female and a male connector, one of the connectors being installed on a mounting base and projecting through a holder in a waiting position, said one connector capable of being freely coupled with the other connector in a direction of the projected waiting position of said one connector, said connector coupling structure being such that said one connector is freely slidable in said holder, and after said other connector is coupled with said one connector and before said other connector is fixedly installed, both the connectors are freely slidable relative to said holder beyond said waiting position toward said mounting base while in a completely coupled condition.

2. A connector coupling structure according to claim 1, wherein said holder is cylindrical in shape and wherein the coupled connectors are provided slidably in the cylindrical holder.

3. A connector coupling structure according to claim 1, wherein said other connector is installed on another mounting base and is attached to a switch, the switch attached to said other connector being installed in a switch mounting hole provided in the other mounting base and wherein said switch installed in the switch mounting hole may be locked into the switch mounting hole by a locking means on the switch.

4. A connector coupling structure comprising a female and a male connector, one of the connectors being installed on a mounting base and projecting through a holder in a waiting position, said one connector capable of being freely coupled with the other connector in a direction of the projected waiting position of said one connector, said connector coupling structure being so constructed that a clearance is provided between said holder and said one connector such that said one connector is slidable in said holder, and when the coupling of said one connector and said other connector is complete and before said other connector is fixedly installed, both the connectors are freely slidable relative to said holder beyond said waiting position toward said mounting base while in the completely coupled condition.

5. A connector coupling structure according to claim 4, said other connector is installed on another mounting base and is attached to a switch, wherein the switch attached to said other connector being installed in the switch mounting hole provided in the other mounting base and wherein the clearance between said holder and said one connector is set so as to be larger than the clearance between said switch mounting hold and said switch.

6. A connector coupling structure comprising a female and a male connector; one of the connectors installed on a mounting base and projecting through a holder in a waiting position, said one connector capable of being freely coupled with the other connector in a direction of the projected waiting position of said one connector, said connector coupling structure being so constructed that a hood of said one connector is provided slidably in said holder; said holder and hood of said one connector are each provided with an engaging means for holding the one connector in the projected waiting position; said other connector being provided with a holding means for holding the engagement of each of said engaging means when both the connectors are coupled with each other, and also provided with a holding release means for releasing the engagement of each of said engaging means when the coupling of the connectors to one another is complete; and when the coupling of the connectors is complete and before said other connector is fixedly installed, both the connectors are slidable relative to said holder beyond said waiting position toward said mounting base while in the completely coupled condition.

7. A connector coupling structure according to claim 6, wherein said hood is cylindrical in shape and the cylindrical hood acts as a guide for said holder and said other connector.

8. A connector coupling structure according to claim 6, wherein said one connector comprises a housing having a plurality of terminal accommodating chambers and a hood for covering the housing.

9. A connector coupling structure comprising a female and a male connector, one of the connectors installed on a mounting base and projecting through a holder in a waiting position, said one connector capable of being freely coupled with the other connector in a direction of the projected waiting position of said one connector, said connector coupling structure being so constructed that said one connector is provided slidably in said holder, and when a coupling of said one connector and said other connector is complete and before said other connector is fixedly installed, both the connectors are freely slidable relative to said holder beyond said waiting position toward said mounting base; said holder and one connector are each provided with an engaging means for holding the one connector in the projected waiting position; said other connector being provided with a holding means for holding the engagement of each of said engaging means when both the connectors are coupled with each other, and also being provided with a holding release means for releasing the engagement of each of said engaging means when the coupling of the connectors to one another is complete and released; and both the connectors are freely slidable relative to said holder when the coupling of both connectors is complete and released.

10. A connector coupling structure according to claim 9, wherein a uncoupling face of said holding release means is a tapered face.

11. A connector coupling structure comprising a female and a male connector, one of the connectors installed on a mounting base and projecting through a holder in a waiting position, said one connector capable of being freely coupled with the other connector in a direction of the projected waiting position of said one connector; said one connector provided slidably in said holder, and when a coupling of said one connector and said other connector is complete and before said other connector is fixedly installed, both the connectors are freely slidable relative to said holder beyond said waiting position toward said mounting base; said holder and one connector are each provided with an engaging means for holding the one connector in the projected waiting position; said other connector being provided with a holding means for holding the engagement of each of said engaging means when both the connectors are coupled with each other, and also being provided with a holding release means for releasing the engagement of each of said engaging means when the coupling of the connectors to one another is complete, said connector coupling structure being so constructed that the engaging means of said holder includes a flexible arm having an engaging portion at an end thereof; the engaging means of said one connector includes a flexible engaging piece having an engaging portion to be fit to and released from the engaging portion of said flexible arm; and the flexible engaging piece is freely contactable with a side wall in a vicinity of the flexible arm of said holder.

12. A connector coupling structure according to claim 11, wherein a width of said flexible engaging piece is set so as to be larger than a width of the engaging portion of said flexible arm.

* * * * *